US005167668A

United States Patent [19]

Hähnke et al.

[11] Patent Number: 5,167,668

[45] Date of Patent: Dec. 1, 1992

[54] PROCESS FOR LEVEL EXHAUST OF CELLULOSE FIBERS WITH REACTIVE DYES: ADDITION OF FIXING ALKALI ACCORDING TO A PARABOLIC TIME FUNCTION

[75] Inventors: Manfred Hähnke, Kelkheim; Pablo Canora, Hofheim am Taunus, both of Fed. Rep. of Germany

[73] Assignee: Hoechst Aktiengesellschaft, Frankfurt am Main, Fed. Rep. of Germany

[21] Appl. No.: 617,944

[22] Filed: Nov. 26, 1990

Related U.S. Application Data

[63] Continuation of Ser. No. 406,824, Sep. 13, 1989, abandoned, which is a continuation of Ser. No. 256,137, Oct. 6, 1988, abandoned, which is a continuation of Ser. No. 856,694, Apr. 25, 1986, abandoned.

[30] Foreign Application Priority Data

Apr. 29, 1985 [DE] Fed. Rep. of Germany ..... 3515407

[51] Int. Cl.[5] ..... D06P 1/38; D06P 3/66

[52] U.S. Cl. ..... 8/400; 8/531; 8/532; 8/534; 8/543; 8/549; 8/918

[58] Field of Search ..... 8/400, 543, 549

[56] References Cited

U.S. PATENT DOCUMENTS

| | | | |
|---|---|---|---|
| 3,117,957 | 6/1964 | Boyd et al. | 8/400 |
| 3,767,356 | 10/1973 | Turner | 8/400 |
| 4,089,644 | 5/1978 | Carbowell et al. | 8/400 |
| 4,372,744 | 2/1983 | Hildebrand et al. | 8/400 |
| 4,562,604 | 1/1986 | Damm | 8/158 |
| 4,629,465 | 12/1986 | Hasler et al. | 8/400 |
| 4,645,510 | 2/1987 | Hasler et al. | 8/400 |
| 4,656,846 | 4/1987 | Damm et al. | 68/207 |

FOREIGN PATENT DOCUMENTS

| | | |
|---|---|---|
| 3515406 | 10/1986 | Fed. Rep. of Germany . |
| 84-1967 | 7/1984 | South Africa . |

*Primary Examiner*—A. Lionel Clingman

[57] ABSTRACT

In an existing isothermal dyeing process, the alkali required for dye fixation is added to the neutral dyebath under linear or progressive program control. In this process, the amount of alkali added per unit time is small at the beginning and is increased progressively and in accordance with a program. This process passes through a certain (non-controlable) initial phase until the start of dye fixation on the cellulose. As a consequence the rate of fixation passes through a maximum before gradually decreasing when the final state of the dyeing is reached. To shorten the initial phase (waiting time) of dye fixation and to slow down dye fixation during the steepest part, it has proved advantageous according to the invention to add the alkali in accordance with a parabolic program.

6 Claims, 5 Drawing Sheets

Figure 1:
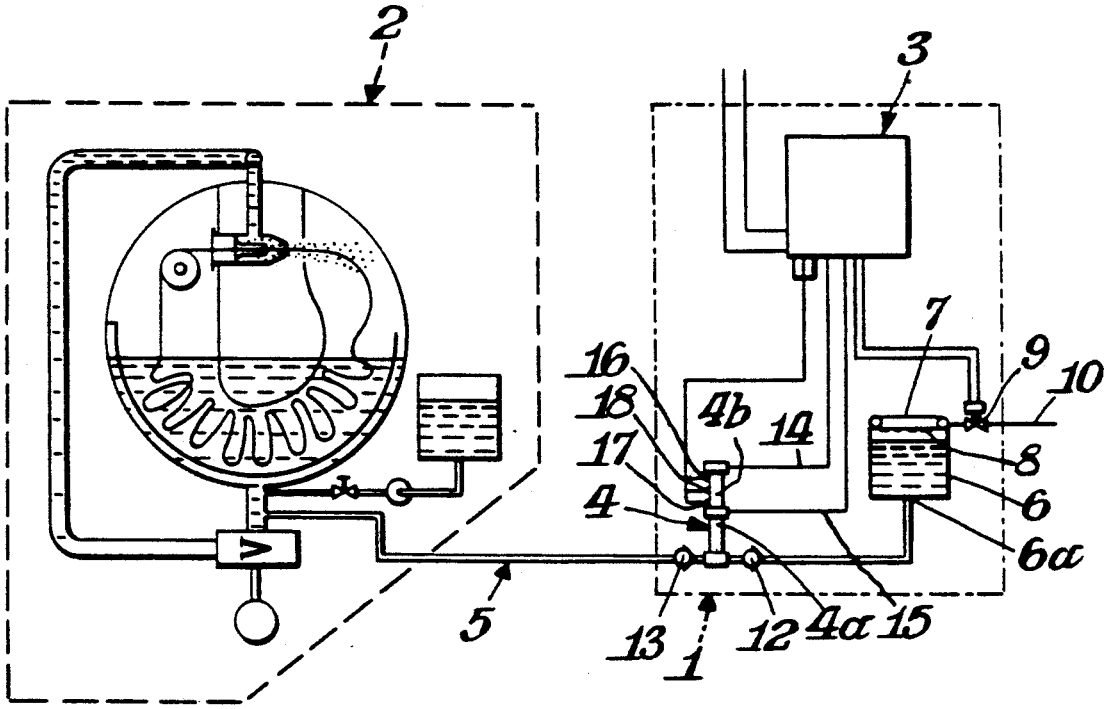
Figure 2:
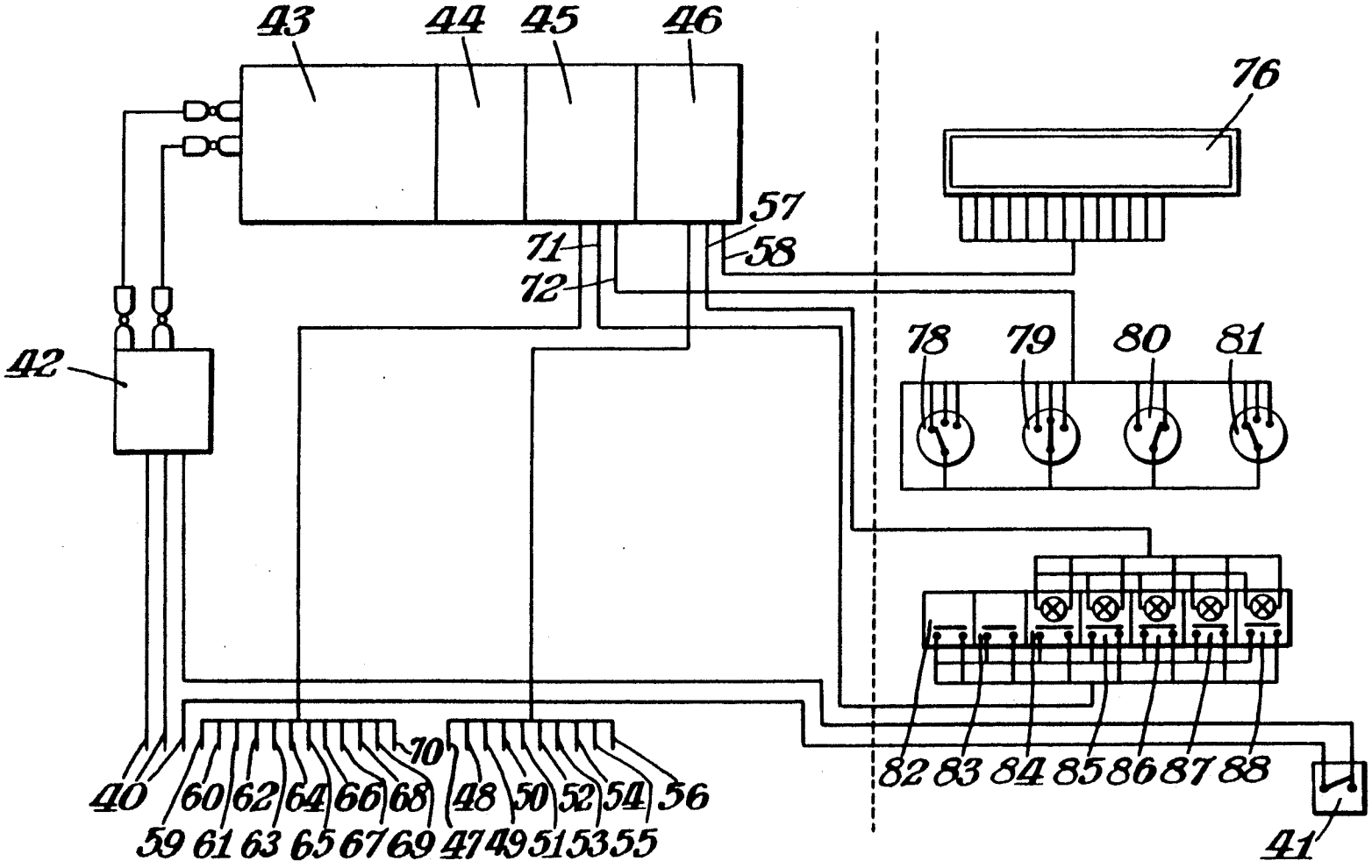
Figure 3:
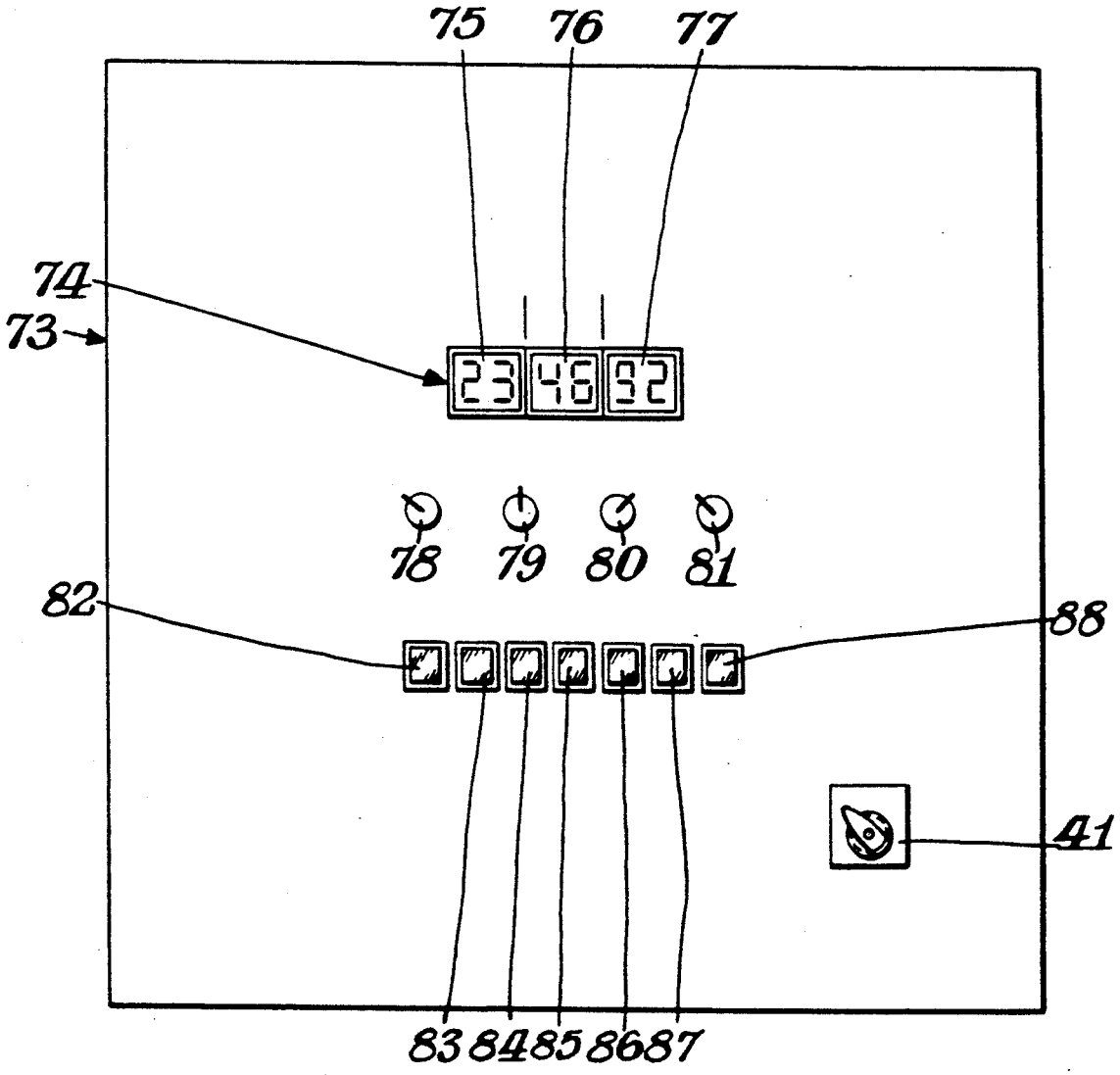
Figure 4:
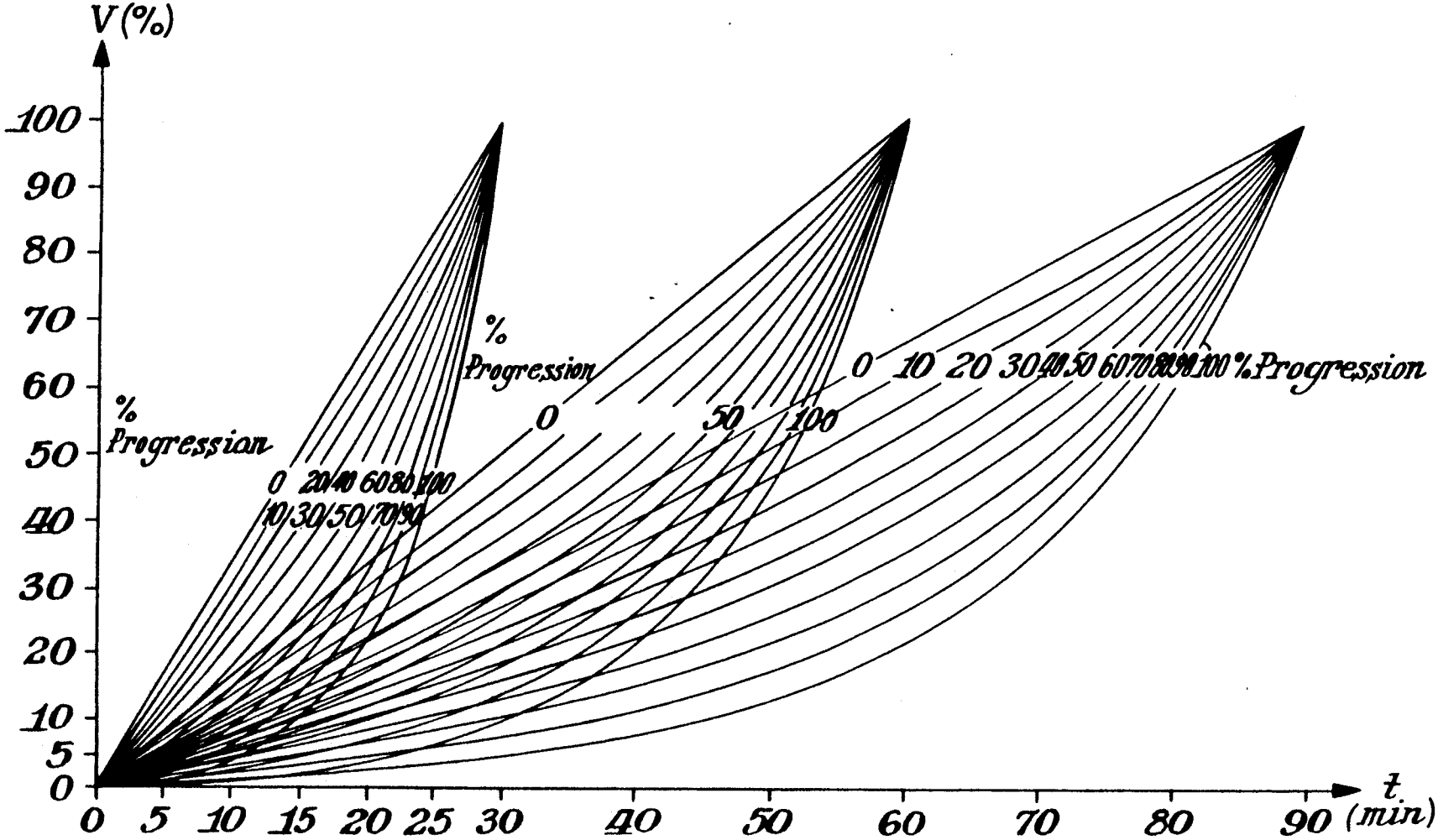
Figure 5:
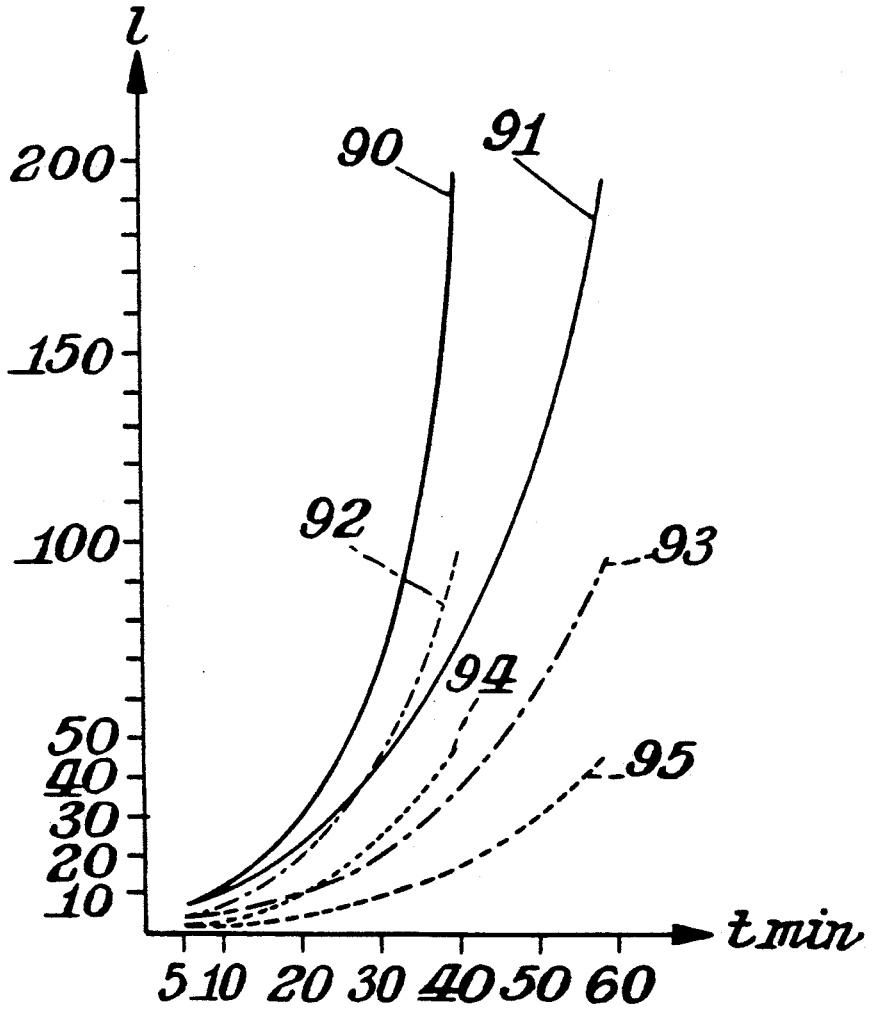

PROCESS FOR LEVEL EXHAUST OF CELLULOSE FIBERS WITH REACTIVE DYES: ADDITION OF FIXING ALKALI ACCORDING TO A PARABOLIC TIME FUNCTION

This application is a continuation of our copending application Ser. No. 07/406,824, filed Sep. 13, 1989, now abandoned, which is a continuation of Ser. No. 07/256,137, filed Oct. 6, 1988, abandoned, which is a continuation of our earlier copending application Ser. No. 06/856,694, filed Apr. 25, 1986, now abandoned.

The dyeing of textile material made of cellulose fibers by exhausting reactive dyes which become fixed under alkaline conditions from an aqueous medium is by far the largest and most important field of use for this class of dyes and is customarily effected in accordance with previous methods in the "all-in process", or in a "prerun process" or in a "stagewise process", which differ from one another in the way the process is carried out. These processes allow for the fact that the risk of unlevelness is very high when, in a reactive dyeing, all the alkali required for fixation is available all at once at the dyeing temperature to the dye- and electrolyte-containing liquor, thereby effecting a rapid increase in fixation of dye.

To counteract undesirably rapid fixation of the dye in the initial phase of the dyeing, the method employed with the customary "all-in process" is therefore to feed the total amount of dye, salt, alkali and, if appropriate, a textile assistant at a low temperature (room temperature) into the dyeing machine charged with the exhaust bath and the textile material; thereupon the batch thus prepared is heated to the intended dyeing temperature, and the initiated methods for coloring the textile material are then brought to completion under the set temperature conditions over a certain period, during which fixation takes place. If this process is used on rapidly fixing dyes if otherwise difficult material and/or machine conditions are present, the resulting dyeing is frequently only of inadequate levelness.

Owing to this unsatisfactory dyeing result there has therefore been no shortage of attempts to control the course of fixation (i.e. the rate of reaction) not by guiding the temperature of the treatment operation in a special way but by dosing the alkali adds and—by modifying the abovementioned dyeing technique—to develop for the stated object a "prerun process" (introduction of dye and salt into the liquor with the textile material at room temperature and then, after the heatup to the dyeing temperature, of the fixing alkali in a plurality of portions and at certain time intervals) or a "stagewise process" (the hot liquor which contains textile material and dye and is under fixing conditions has added to it first the salt and a relatively weak alkali and only later, in portions in 1–3 stages, the stronger alkali for final fixation) in order to bring about a more level dyeing. However, this object was only achieved gradually by these means, usually through acceptance of longer overall dyeing times, which is equivalent to accepting reduced productivity.

Furthermore, the desire to obtain satisfactory levelness underlies the description in U.S. Pat. No. 4,372,744 of a further dyeing process in which, unlike the previously discussed state of the art, the dye is metered at the fixing temperature into the dyebath, which contains the cellulosic textile material and also alkali, electrolyte and, if appropriate, a textile assistant, in such amounts that always, i.e. throughout the entire duration of the dyeing, less than 10% of the dye which at the end of the dyeing is fixed on the fiber are present in reactive form but unfixed in the dyebath. Yet this process is not very suitable for use in the field since continuous measurement/control of the concentration of reactive dye in the dyebath would have to be associated with an extremely high workload (HPLC or coloristic examination by separate serial experiments).

Moreover, South African Patent Specification ZA-A-84/1967 discloses an isothermal dyeing process, which is being practiced in the field, in which the alkali required for fixing the reactive dye is continuously metered at the dyeing temperature into an aqueous dyebath which contains the dye, electrolyte, if appropriate a textile assistant and the cellulosic textile material. In this process, the alkali is metered in automatically; at the start the amount of alkali per unit time is small, and the amount of alkali added is progressively increased in the course of the metering process in accordance with a certain program. The degree of progressiveness of the metering can be controlled between 0% (linear) and 100% (exponential or logarithmic) in 10% steps. The metering time can be 30, 60 or 90 minutes. (cf.: "textil praxis international", volume 39 (May 1984), pages 493–496). However, this process still has a number of defects: critical for the fixation of reactive dyes on cellulose fibers is the presence of a certain minimum pH value. If the dyeing process claimed in said South African Patent 84/1967 is followed, then, depending on the composition of the dyebath and on the programming of the metering of the alkali, a non-determinable (non-controllable) time elapses until the "critical" pH value at which the bulk amount of the dye is fixed is reached. This waiting time leads to a prolonged dyeing cycle and hence to reduced productivity.

For this reason there was a need to improve and further develop the measures for optimizing the process conditions in the exhaust dyeing of cellulose fibers with reactive dyes, which is also the object of the present invention.

We have found, surprisingly, that it is possible to overcome the previously mentioned defects of conventional processes for exhaust dyeing cellulose fibers with reactive dyes by not effecting the control of the metering of alkali into the dyebath on the basis of variable progression alone, but by executing this operation in quantitative terms in accordance with a parabolic program. As a result it is advantageously possible on the one hand to shorten the initial period (waiting time) of dye fixation and on the other to slow down dye fixation during its steepest part (increase in fixation as a function of progression and time, illustrated by diagrammatic representation of the curve of fixation), which has a very favorable effect on the appearance of the textile material.

The present invention thus provides a process for level dyeing of textile material made of cellulose fibers in an aqueous medium by the exhaust method with reactive dyes which are fixable under alkaline conditions, which comprises adding the alkali required for dye fixation in a continuous or quasi-continuous manner over a predetermined period of time in an amount per unit time which varies in the manner of a parabolic function at the fixing temperature to the exhaust bath which contains the material to be dyed, at least one such dye and, if appropriate, all other ingredients but no fixing alkali.

Conveniently the abovementioned process is carried out automatically by means of a computer-controlled dosing apparatus (for example of the prototype depicted in South African Patent 84/1967) which by reason of its constructional features is capable of controling the addition of the alkali to the liquor, which is directly under fixing conditions, in accordance with the abovementioned metering schedule.

According to the present invention, the fixing alkali can be added to the alkali-free dyebath at a constant temperature within the range 30–100° C.; but it is also possible to raise or lower the temperature during the actual metering operation. Preference is given to the isothermal option, and depending on the type of dye or kind of substrate a relatively low temperature (range about 30–50° C.) or a relatively high temperature (range about 60–100° C.) is chosen.

The measures according to the invention for the continuous or approximately continuous control of the mode of addition based on metering in accordance with a parabolic function are to be understood as meaning that the amount of alkali added to the dyeing liquor per unit time is relatively high at the beginning of the metering process, then continuously or incrementally decreases to a minimum, and finally increases continuously or incrementally until all the alkali required for dye fixation has been consumed. The guidelines which are to be adopted in a particular case for programing the amount of alkali to be added per unit time depend on the type of reactive dye or, more specifically, of its reactive attachment system, on the nature of the textile material and on the nature of the dyeing apparatus used (for stationary or moving textile material). The characteristic of the dosage curve represented by means of the diagram (as a function of progression and time) can be relatively flat or relatively steep. The entire dosage process can in general be concluded within a period between 10 and 120 min, preferably between 15 and 60 min, which accounts for a substantial portion of the overall dyeing time.

To record the course of the dosage of the amount of alkali it is possible to make use of rational mathematical functions, for example of a wholly rational function of the n-th degree:

$$y=a_n\cdot x^n+a_{n-1}\cdot x^{n-1}+\ldots a_1\cdot x+a_o$$

such as, for example of the following general quadratic equation:

$$y=ax^2+bx+c$$

or of a trigonometric function:

$$y=b\cdot\sin a\cdot x+c\cdot x$$

where y=amount of alkali to be added per unit time x=time n, a, b, c=unequal or equal real numbers.

For the purposes of the invention, a quasi-continuous metering of alkali is a process in which the mode of addition for the amounts of alkali follows the course of a parabola over the entire dosage period, but in which the metering measures take place in individual thrusts (for example analogously to the rhythm of a piston pump) or in which the rate of addition remains in each case constant for a certain time (of the order of seconds or minutes) and then incrementally changes to reduced or increased values. The alkali metering according to the invention can thus also proceed by adding certain constant unit amounts of the alkali with such timing that the result considered over the entire dosage period, is the curve of a parabola.

The alkali to be used for dye fixation in the process can be an alkali metal hydroxide, carbonate, hydrogencarbonate, phosphate, metaphosphate, pyrophosphate or polyphosphate or any other alkaline substance or even a mixture of various of these alkalis, in particular the corresponding sodium compounds. The required amount and selection of these alkalis depends on the type of reactive dye used or more specifically on its reactive attachment system and conforms to the recipes which are customary for this purpose in practical dyeing.

The process according to the invention leads to a surprisingly favorable, i.e. uniform, course of dye fixation. As a result, the dyeing process can be concluded in a substantially shorter time than was possible in the prior art, and nonetheless or in addition it is still possible to obtain an excellent levelness for the dyeing.

To dye cellulose fibers or the cellulose fiber portion of fiber mixtures by the present invention, suitable reactive dyes are the organic dyes which are known under this generic term—irrespective of the nature of their fiber—reactive group. This class of dyes is referred to in the Colour Index, 3rd edition 1971 and supplements 1975 as C.I. reactive dyes and comprises chemical compounds of dye character which enter a covalent bond with OH-containing fibers. They are predominantly dyes which contain at least one group capable of reaction with polyhydroxy fibers; a precursor thereof; or a substituent capable of reaction with the polyhydroxy fiber. Suitable basic structures for the chromophoric system of these organic dyes are in particular those from the series of the azo, anthraquinone and phthalocyanine compounds, it being possible for the azo and phthalocyanine dyes to be not only metal-free but also metal-containing.

Reactive groups and precursors which form such reactive groups are for example epoxy groups, the ethyleneimide group, the vinyl grouping in the vinylsulfonyl or in the acrylic acid radical, and also the β-sulfatoethylsulfonyl group, the β-chloroethylsulfonyl group or the β-dialkylaminoethylsulfonyl group. Also suitable for this process are derivatives of the tetrafluorocyclobutyl series, for example of tetrafluorocyclobutylacrylic acid. Suitable reactive substituents in reactive dyes are those which are readily detachable and leave behind an electrophilic radical. Suitable substituents in this respect are for example 1 to 3 halogen atoms on the following ring systems: quinoxaline, triazine, pyrimidine, phthalazine, pyridazine and pyridazone. It is also possible to use dyes having a plurality of identical or different reactive groups, and also combinations of dyes of the same or different types. These reactive dyes of the previously defined type frequently have more than one sulfo group (in addition to that in the reactive grouping of the dye) in the molecule, which can be distributed over the chromophore in any desired manner, but are preferably bonded to its aromatic radicals.

To carry out the claimed process preference is given to using dyes of the vinylsulfonyl type, with which the fiber reacts by an addition mechanism via the vinylsulfonyl form of the dye and which possess as the reactive attachment system either the vinylsulfonyl radical itself or the β-sulfatoethylsulfonyl group. Similarly useful coloring substances are those dyes which, in addition to a reactive radical of the vinylsulfonyl type or a precursor thereof, have at least one grouping which reacts with the cellulose by the substitution mechanism, for example a monochlorotriazinyl or monofluorotriazinyl group.

Cellulose fibers which are to be dyed according to the invention are to be understood as meaning cotton, mercerized or causticized cotton, conventional regenerated cellulose fibers, ®Modal fibers and other vegetable fibers, such as, for example, flax. The process according to the invention is also suitable for mixtures within the abovementioned fibers and with other fibers, such as, for example, polyester, polyamide or acrylic fibers or silk.

The dyeing itself can be carried out at various stages in the processing or makeup of the textile material, such as for example at the loose fiber, slubbing, yarn, woven or knitted fabric or bonded fiber web stage. Any machines and apparatuses which are customary in the field for such dyeings by the exhaust method can be used for carrying out the new process.

The examples given below serve to illustrate the inventive idea and shall not restrict the claimed process in any way. The percentages mentioned therein are based on the weight of the items thus designated. The reactive dyes mentioned are used in commercially available form and constitution.

EXAMPLE 1

To carry out an exhaust dye using a liquor ratio of 10:1, a jet dyeing machine is charged with 25 kg of woven cotton cloth and with 250 L of water at 40° C. The liquor thus prepared then has added to it 0.5 kg of a reactive dye of the formula

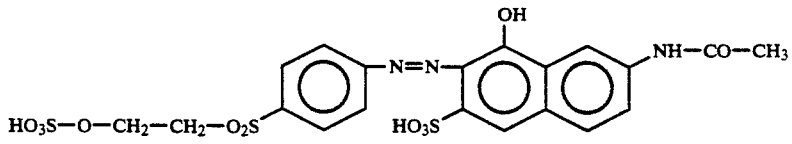

dissolved in a little hot water, and 12.5 kg of Glauber's salt, and the fabric rope is then allowed to circulate for 5 min with simultaneous circulation of the treatment liquid until the adds are uniformly distributed. Thereafter, while liquor circulation continues, the metered addition of a total of 527 $cm^3$ of concentrated sodium hydroxide solution (38° Be) is started, the fixing alkali being added in portions at equal time intervals as follows:

| Dosage time | 0 | 1 | 2 | 3 | 4 | 5 | 6 | 7 | 8 | 9 | 10 | 11 | 12 | 13 | 14 | 15 | 16 | min* |
|---|---|---|---|---|---|---|---|---|---|---|---|---|---|---|---|---|---|---|
| Amount added | 31 | 21 | 13 | 7 | 3 | 1 | 1 | 3 | 7 | 13 | 21 | 31 | 43 | 57 | 73 | 91 | 111 | $cm^3$/min |

* = dosage time from the start of metered addition

During this measure the temperature of the exhaust bath is maintained at a constant 40° C.

After addition of all the sodium hydroxide solution, the textile material is dyed to completion at the set temperature in the course of a further 20 min, and this dyeing is then finished in the usual manner by rinsing, acidifying, soaping and renewed rinsing. The result obtained is a gray dyeing of very high levelness.

EXAMPLES 2 TO 15

If in the dyeing process of Example 1 the reactive dye defined there by its structure is replaced here in each case by one of the reactive dyes mentioned below and the other dyeing conditions are left unchanged, then completely level dyeings are likewise obtained:

| Example | Reactive dye of the formula |
|---|---|
| No. 2 | 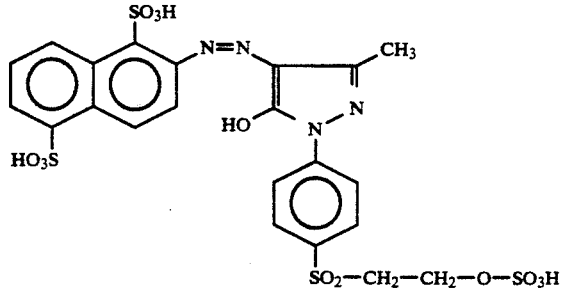 |

-continued
Example Reactive dye of the formula
No. 3
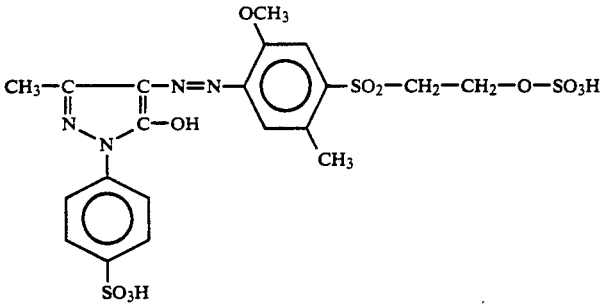
No. 4
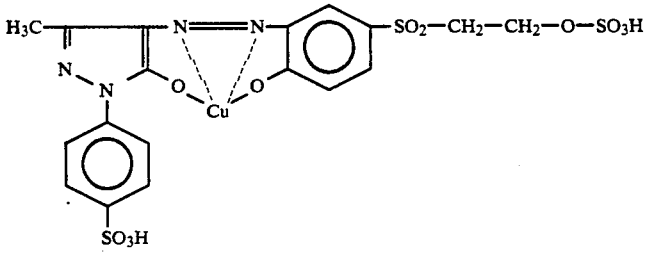
No. 5
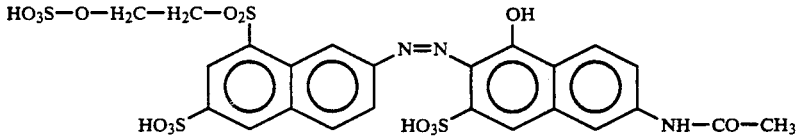
No. 6
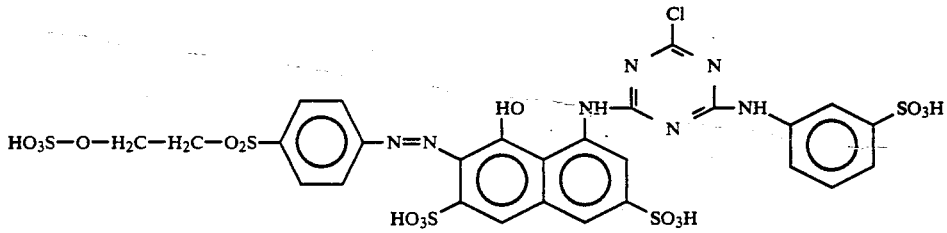
No. 7
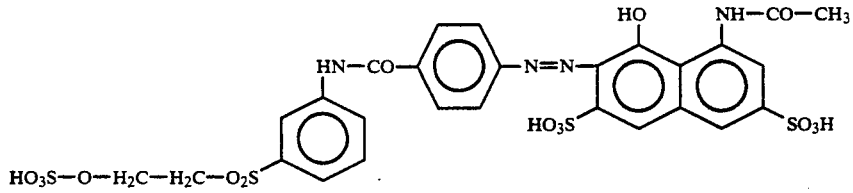
No. 8
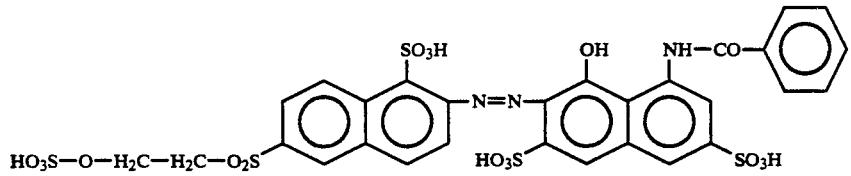
No. 9
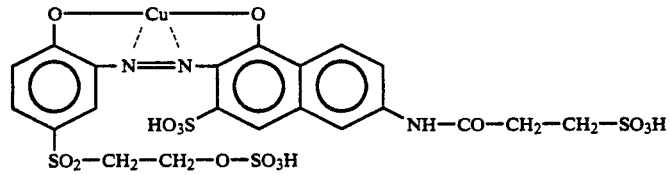
Reactive Violet 5 with the C.I. No. 18097
No. 10

-continued

Example Reactive dye of the formula

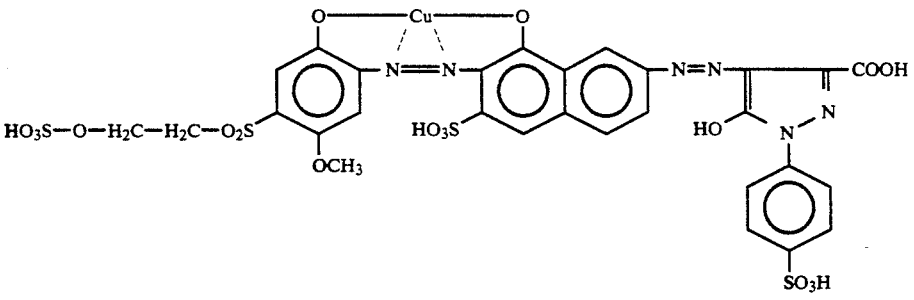

No. 11

Reactive Blue 19 with C.I. No. 61200

No. 12

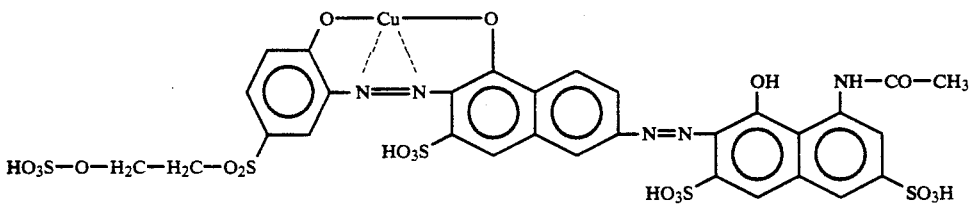

No. 13

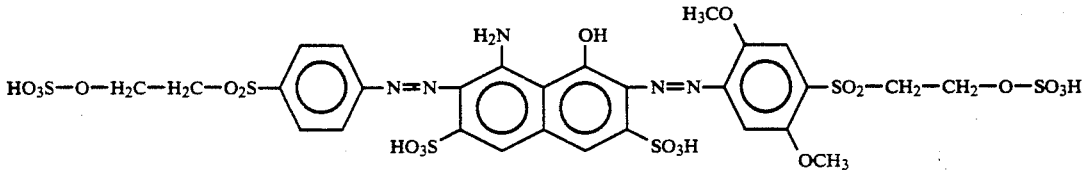

No. 14

Reactive Black 5 - C.I. No. 20505

No. 15

EXAMPLE 16

If in the exhaustion dyeing with the treatment recipe of Example 1 the cotton fabric used there is replaced here by a blend fabric of 30% polyester fibers and 70% cotton, then completely level gray dyeing is obtained on the a cotton component, and the polyester fiber portion of the dyed material can subsequently be dyed with commercially available disperse dyes until a solid shade is obtained.

EXAMPLE 17

A yarn dyeing machine is entered with 75 kg of cotton yarn in the form of packages, and the dyeing vessel is then charged with 750 L of water of 50° C. To this liquor are then added, while the circulation pump is running, 22.5 kg of Glauber's salt and a preparation (brought to pH 7) of 500 g (dissolved in water) of a reactive dye of the formula

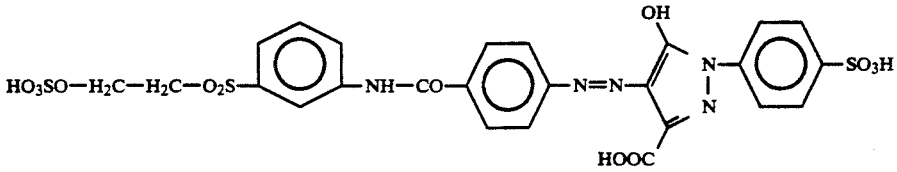

Thereafter, while the temperature of 50° C. in the circulating bath is maintained, a start is made on the metered addition of a total of 8800 $cm^3$ of concentrated sodium hydroxide solution (38° Be) diluted with water in a ratio of 1:10, and the dosage stagger described below is maintained:

| | | | | | | | | | | | | | | | | | |
|---|---|---|---|---|---|---|---|---|---|---|---|---|---|---|---|---|---|
| Dosage time | 0 | 4 | 8 | 12 | 16 | 20 | 24 | 28 | 32 | 36 | 40 | 44 | 48 | 52 | 56 | 60 | min |
| Amount added | 125 | 80 | 45 | 20 | 5 | 0 | 5 | 20 | 45 | 80 | 125 | 180 | 245 | 320 | 405 | 500 | $cm^3$/min |

The textile material is then dyed under the same temperature conditions for 15 min with continued liquor circulation and is then finished as usual. The result obtained is a pink yarn dyeing which on knitting leads to completely level piece goods.

EXAMPLE 18

If the dyeing instructions given in Example 17 are followed, except that a yarn comprising a fiber blend of 70% cotton and 30% polyester fiber predyed with disperse dyes is used, then the result obtained on the cotton portion after conclusion of the dyeing operation is likewise a completely level pink dye.

EXAMPLE 20

To dye by the exhaust method, a jet dyeing machine is charged with 300 kg of cotton tricot and with a liquor of 2700 L of water. After heating to 30° C., this bath has added to it at first 110 kg of a reactive dye of the formula

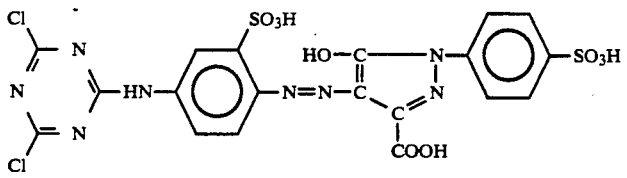

which were dissolved beforehand in 100 L of hot water, and while rotating the textile material, which is in rope form, the dye is distributed in the dyeing medium. After a further 10-minute circulation of the liquor at the same temperature the treatment bath then has added to its 24,375 $cm^3$ of a fixing alkali solution obtained by dissolving 15 kg of sodium carbonate in water, in accordance with the following schedule

| Dosage time | 0 | 5 | 10 | 15 | 20 | 25 | 30 | 35 | 40 | 45 | min |
|---|---|---|---|---|---|---|---|---|---|---|---|
| Amount added | 1200 | 675 | 300 | 75 | 0 | 75 | 300 | 675 | 1200 | 1875 | $cm^3$/min |

After 30 minutes of circulation of the textile rope under the set conditions, the tricot fabric thus treated is finished as usual. The appearance of the orange dyeing obtained in this way is satisfactory and level.

EXAMPLE 21

A reel beck with liquor circulation is loaded with 100 kg of cotton lining fabric and charged with 2000 L of water. To the initial charge of liquor are then added at room temperature 3 kg of a reactive dye of the formula

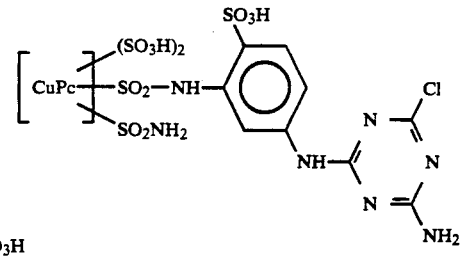

and, after 10 minutes of interim circulation, also 140 kg of sodium chloride in the course of 30 minutes and in the form of 3 portions. By heating the bath temperature is then raised to 80° C. in the course of 30 minutes. During this period, the dyeing batch has added to it 52,896 $cm^3$ of an aqueous solution prepared from 10,000 g of sodium carbonate and 10,000 $cm^3$ of concentrated sodium hydroxide solution (38° Be) a little at a time in accordance with the schedule specified below:

| Dosage time | 0 | 2 | 4 | 6 | 8 | 10 | 12 | 14 | 16 | 18 | 20 | 22 | 24 | 26 | 28 | 30 | min |
|---|---|---|---|---|---|---|---|---|---|---|---|---|---|---|---|---|---|
| Amount added | 133 | 37 | 5 | 37 | 133 | 293 | 517 | 804 | 1157 | 1573 | 2053 | 2597 | 3205 | 3877 | 4613 | 5413 | $cm^3$/min |

After the customary aftertreatment a completely level blue dyeing is obtained on the fabric exhaust-dyed in this way.

EXAMPLE 22

A cheese dyeing apparatus is charged with 25 kg of cotton yarn cheeses arranged on perforated spindles and with 188 L of water. After switching on the one-way circulation pump 375 g of a reactive dye of the formula

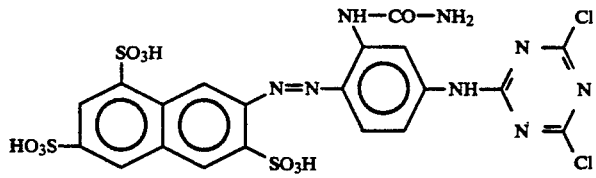

which has been dissolved beforehand in 1 L of hot water, are added to this exhaustion liquor, whereupon the latter is heated to 80° C. in the course of 30 min and 11.2 kg of sodium chloride are added during this period a little at a time. Separately, 14.69 L of an aqueous solution have been made up in the meantime as fixing alkali to contain 2820 g of sodium carbonate, which is then added in the course of 65 min in accordance with the schedule shown below to the dyebath under fixing conditions:

| Dosage time | 0 | 5 | 10 | 15 | 20 | 25 | 30 | 35 | 40 | 45 | 50 | 55 | 60 | min |
|---|---|---|---|---|---|---|---|---|---|---|---|---|---|---|
| Amount added | 201 | 113.5 | 51 | 13.5 | 1 | 13.5 | 51 | 113.5 | 201 | 313.5 | 451 | 613.5 | 801 | $cm^3$/min |

After all the alkali has been added, the textile material is dyed at the same temperature for a further 30 minutes and is then finished as usual.

To assess the result of the dyeing, the yarn was wound from two dyed cheeses onto a fresh cheese in such a way that the inner layers of yarn of the first cheese ended up next to the outer layers of yarn of the second cheese. This comparison showed no detectable differences in shade, which was evidence of a satisfactory level dyeing.

EXAMPLE 23

A jet dyeing machine is loaded with 500 kg of a circular-knit tube material composed of a mixture of 35% polyester fiber and 65% of cotton, and 3,100 L of water are fed into the dyeing container thus charged. While the circulation pump is running, 65 kg of sodium chloride are then added to the initial charge of liquor, and the liquor is then heated to 50° C., whereafter 1,620 g of a reactive dye of the formula

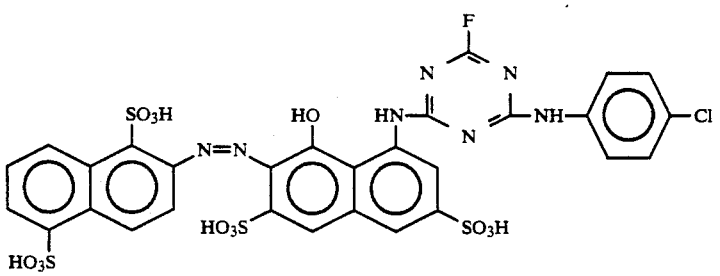

which has been dissolved beforehand in 50 L of hot water, are supplied to the treatment bath via the makeup vessel. This exhaust liquor then has added to it with continued circulation and at constant temperature conditions an aqueous alkali batch of 119.4 L in volume which comprises 9,750 g of sodium carbonate, 165 $cm^3$ of concentrated sodium hydroxide solution (38° Be) and water in the course of 65 minutes in accordance with the mode of addition prescribed in the table below:

| Dosage time | 0 | 5 | 10 | 15 | 20 | 25 | 30 | 35 | 40 | 45 | 50 | 55 | 60 | min |
|---|---|---|---|---|---|---|---|---|---|---|---|---|---|---|
| Amount added | 723.5 | 326 | 87.5 | 8 | 87.5 | 326 | 723.5 | 1280 | 1995.5 | 2870 | 3904 | 5096 | 6448 | $cm^3$/min |

After a further 30 minutes of dyeing after the addition of the fixing alkali the dyeing is finished as usual and is then cross-dyed with commercially available disperse dyes. The shade thus obtained on the cotton component in the material is satisfactorily level.

EXAMPLE 24

92 kg of a yarn-mercerized cotton tricot are introduced into a reel beck without liquor circulation, and the latter is charged with 1,230 L of water and also with 69 kg of Glauber's salt, and the liquor temperature is raised to 90° C. while the reels are turning. In the meantime and separately from the treatment vessel, 1,840 g of a reactive dye of the formula

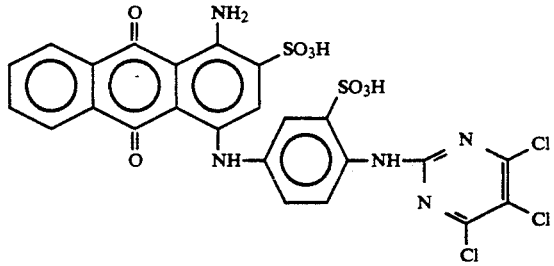

have been dissolved in 50 L of hot water, which are then added at this stage of the treatment process to the liquor by way of the perforated division plate in the course of 10 minutes. Separately, 13.8 kg of sodium carbonate have in the meantime been dissolved in water and been made up to a volume of 119 L with water. This solution is then added via a distributor pipe to the dyebath which is under fixing conditions in accordance with the schedule given below:

| Dosage time | 0 | 10 | 20 | 30 | 40 | 50 | 60 | 70 | 80 | 90 | min |
|---|---|---|---|---|---|---|---|---|---|---|---|
| Amount added | 500 | 150 | 0 | 150 | 300 | 600 | 1200 | 2000 | 3000 | 4000 | $cm^3$/min |

After all the fixing alkali has been added the dyeing is complete and is subjected as usual to the aftertreatment. The resulting blue material is perfectly level.

EXAMPLE 25

A jet dyeing machine is charged with 50 kg of cotton tricot. The dyeing vessel is then charged with 430 L of water and 40 g of sodium chloride; the temperature of the bath is 40° C. Thereafter a mixture of 900 g of a reactive dye of the formula

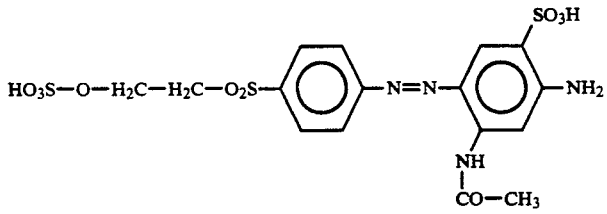

600 g of the dye Reactive Orange 16 with the C.I. No. 17,757 and 900 g of the dye Reactive Blue 19 with the C.I. No. 61200, which has been dissolved beforehand in 50 L of water, is added with continuous circulation of the initial charge of liquor. To fix the dye, an alkaline fixing liquid is made up outside the dyeing vessel. To this end, 2 L of concentrated sodium hydroxide solution (38° Be) are diluted with water to a volume of 24.6 L, and the dilution is introduced into a makeup vessel and then added to the circulation liquor at the dyeing temperature in accordance with the following schedule:

| Dosage time | 0 | 2 | 4 | 6 | 8 | 10 | 12 | 14 | 16 | 18 | 20 | min |
|---|---|---|---|---|---|---|---|---|---|---|---|---|
| Amount added | 720 | 320 | 80 | 0 | 80 | 320 | 720 | 1280 | 2000 | 2880 | 3920 | $cm^3$/min |

The metering is effected by means of an electropneumatically controlled air pressure pump. The attached processor controls the process of addition in accordance with the selected curve. The pressure side of the metering pump is connected to the suction side of the liquor circulation pump.

After 30 minutes of remaining dyeing time under the set conditions the dyeing is complete, and the dyed material is as usual rinsed and washed while hot. The levelness of the brown dyeing thus obtained is excellent.

We claim:

1. In a process for the level dyeing of textile material made from cellulose fibers or mixtures thereof with synthetic fiber types in an aqueous medium by the exhaust technique with reactive dyes which are fixable onto said cellulosic material under alkaline conditions, which process comprises adding an alkaline fixing agent at the fixing temperature and in a substantially continuous or approximately continuous manner, to the exhaust liquor containing the fibrous material to be dyed and at least one such reactive dye and all other ingredients, but containing no alkaline fixing agent, the improvement consisting of (a) adding, at the start of the dyeing process, in one portion 1/400 to 1/15 of the total amount of said alkaline fixing agent required to fix said reactive dyes on said cellulose fibers, (b) then adding continuously or approximately continuously, in the course of at most 20 minutes and in the manner of a parabolic function decreasing towards a value of nearly or equal zero, in a second addition step alkaline fixing agent in an amount of 1/630 to 1/5 of the total amount of said alkaline fixing agent, and (c) finally adding continuously or approximately continuously, in the manner of an increasing parabolic function, the residual alkaline fixing agent.

2. The process as claimed in claim 1 wherein the fixing alkali is added batchwise in a series of individual portions per unit time and the addition rate is varied in the manner of said parabolic function.

3. The process as claimed in claim 1, wherein the addition of alkali is effected automatically, controlled in accordance with a computer program.

4. The process as claimed in claim 1, wherein the addition of alkali takes place at constant temperature.

5. The process as claimed in claim 1, wherein the reactive dyes used are those which have a reactive attachment system of the β-sulfatoethylsulfonyl or vinylsulfonyl type.

6. The process as claimed in claim 1, wherein the textile material which contains cellulosic fibers is present as a mixture with polyester, acrylic or polyamide fibers or with silk.

* * * * *